United States Patent [19]

Bohleen et al.

[11] 4,268,077

[45] May 19, 1981

[54] SELF-STORING DOOR HANDLE

[75] Inventors: Brian O. Bohleen, Kenosha, Wis.; Randall C. Hansen, Gurnee, Ill.

[73] Assignee: Abex Corporation, New York, N.Y.

[21] Appl. No.: 937,394

[22] Filed: Aug. 28, 1978

[51] Int. Cl.[2] ..... E05C 13/02; E05C 3/08

[52] U.S. Cl. ..... 292/336.3; 292/DIG. 31; 292/210; 292/DIG. 61

[58] Field of Search ..... 292/113, 218, DIG. 31, 292/DIG. 61, 223, 226, 97, 123, 126, 336.3

[56] References Cited

U.S. PATENT DOCUMENTS

| | | | |
|---|---|---|---|
| 3,153,553 | 10/1964 | Sandor | 292/DIG. 31 |
| 3,918,751 | 11/1975 | Blake | 292/DIG. 31 |
| 4,134,281 | 1/1979 | Pelcin | 292/218 |

*Primary Examiner*—Richard E. Moore

*Attorney, Agent, or Firm*—Thomas S. Baker, Jr.; David A. Greenlee

[57] ABSTRACT

A door actuator for a commercial vehicle includes a mechanism which biases the handle to a stored position and a latch which maintains the handle in the stored position. A key operated lock mechanism cooperates with the latch to lock the handle in the stored position.

8 Claims, 7 Drawing Figures

SELF-STORING DOOR HANDLE

FIELD OF THE INVENTION

The subject invention relates to a self-storing, flush-mounted door actuator of the type commonly used on commercial vehicles.

BACKGROUND OF THE INVENTION

A common problem of vehicles which have flush-mounted door actuators which are not self-storing is that, after the door handle has been moved to the open position to unlatch the door, the handle remains in the open position projecting perpendicular to the vehicle door. When the door is swung open and laid flat against the side of the vehicle, the handle pierces the sidewall of the vehicle. This necessitates costly repair.

It is desirable to have a flush-mounted door actuator which is self-storing, i.e., which biases the door handle to the flush or closed position whenever the handle is released. Door actuators are commonly riveted to the vehicle body and can be serviced only by removing the actuator which is time consuming and expensive. It is also desirable to be able to service the mechanism for biasing the handle to the closed position from outside the vehicle without having to remove the door actuator from the vehicle body.

A padlock is commonly used on door actuators to prevent unauthorized persons from opening the door. For quick, frequent deliveries, a padlock is inconvenient to use. It is desirable to have a simple key-lock mechanism on the door actuator to prevent unauthorized persons from opening the door.

SUMMARY OF THE INVENTION

It is an object of the instant invention to provide a flush-mounted door actuator which includes a device for biasing the handle to the closed position. It is a further object of the instant invention to provide a flush-mounted door actuator which has an integral key-lock mechanism for locking the handle in the closed position. The biasing means and the lock mechanism can be replaced without removing the door actuator from the vehicle body.

DESCRIPTION OF THE PREFERRED EMBODIMENT

Figure 1:
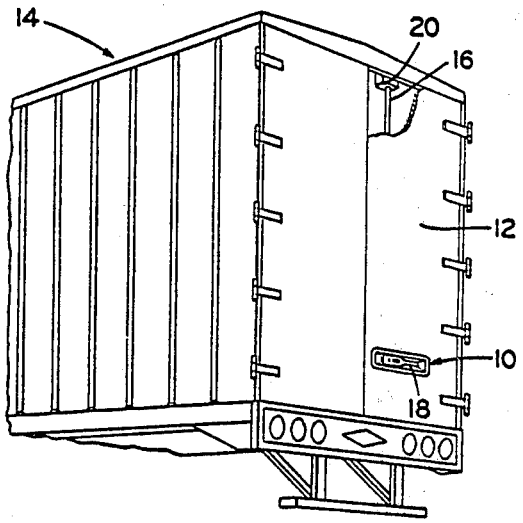
FIG. 1 shows a door actuator according to the instant invention mounted in the door of a commercial vehicle.
Figure 2:
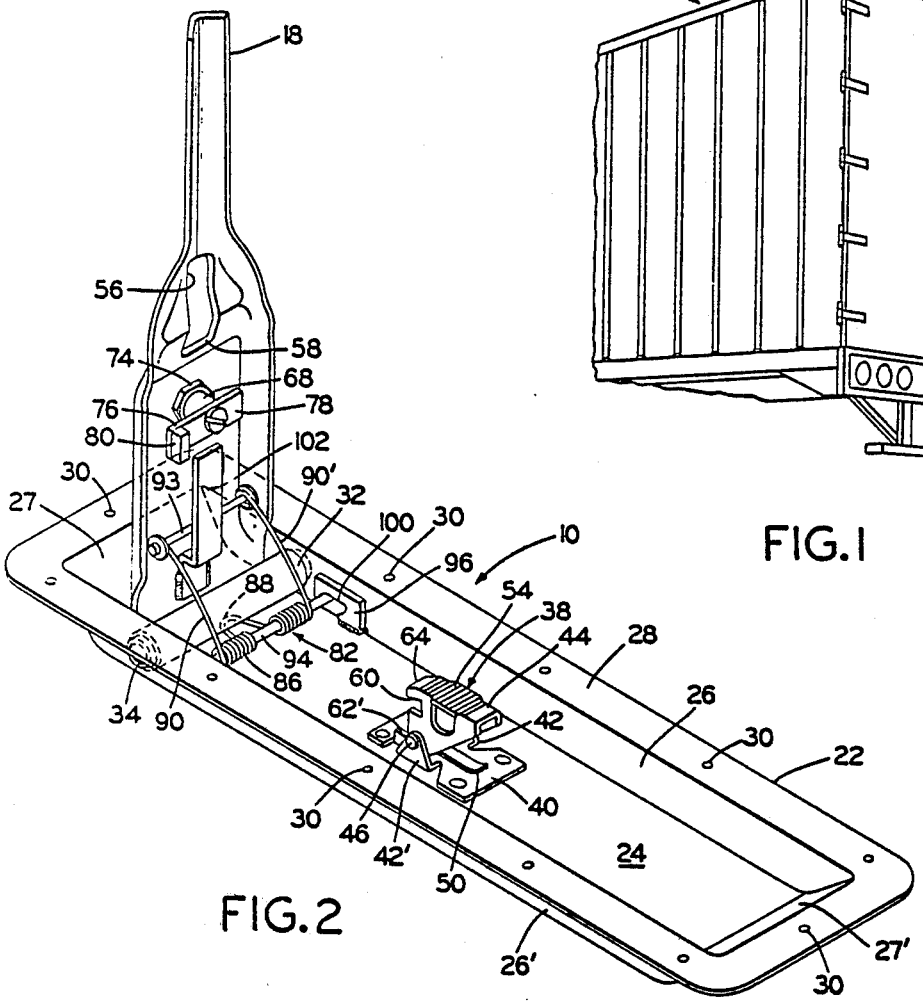
FIG. 2 is a perspective view of the door actuator with the handle shown in the open position.
Figure 3:
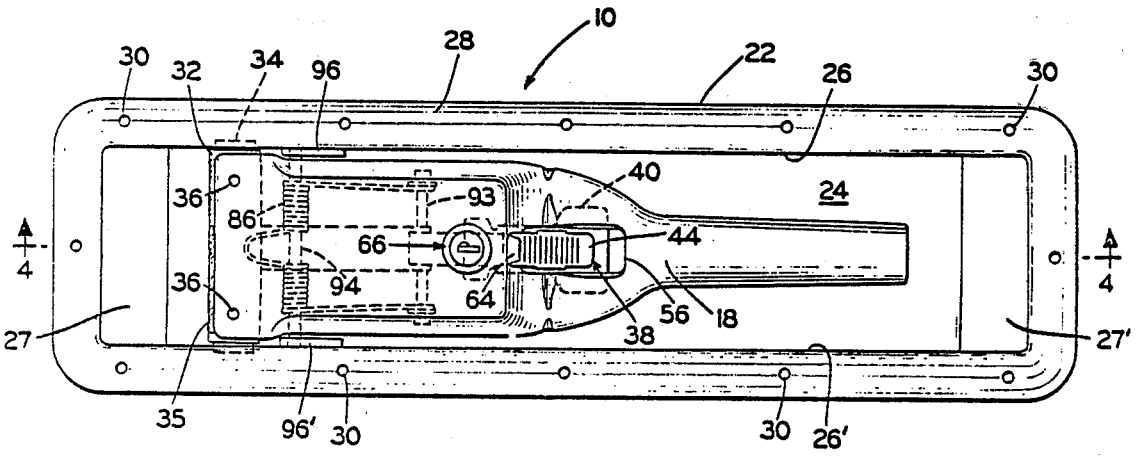
FIG. 3 is a plan view of the door actuator with the handle shown in the closed or stored position.

Referring to FIG. 1 of the drawings, a door actuator 10 is shown flush-mounted in the door 12 of a commercial vehicle 14. The door actuator 10 is rigidly connected to a rod 16, as described hereinafter, such that the rod 16 pivots when an actuator handle 18 is moved between the open and closed position. The end of rod 16 is offset and engages a latch mechanism 20 mounted on the vehicle body to secure door 12 in the closed position when handle 18 is in the closed position. Rod 16 disengages from latch mechanism 20 to permit door 12 to open when handle 18 is moved to the open position in which it projects perpendicularly to door 12. The cooperation of rod 16 and latch mechanism 20 is well known.

Referring to FIGS. 2–5, the door actuator 10 includes a pan 22 which has a recessed bottom portion 24, a pair of longitudinal sidewalls 26, 26', a pair of sloping, lateral sidewalls 27, 27' which extend from bottom portion 24, and a mounting ledge 28 which forms the top of the two pairs of sidewalls 26, 26' and 27, 27' and extends outwardly therefrom. A plurality of holes 30 are bored in mounting ledge 28. Fasteners such as rivets, not shown, attach door actuator 10 to door 12.

Figure 4:
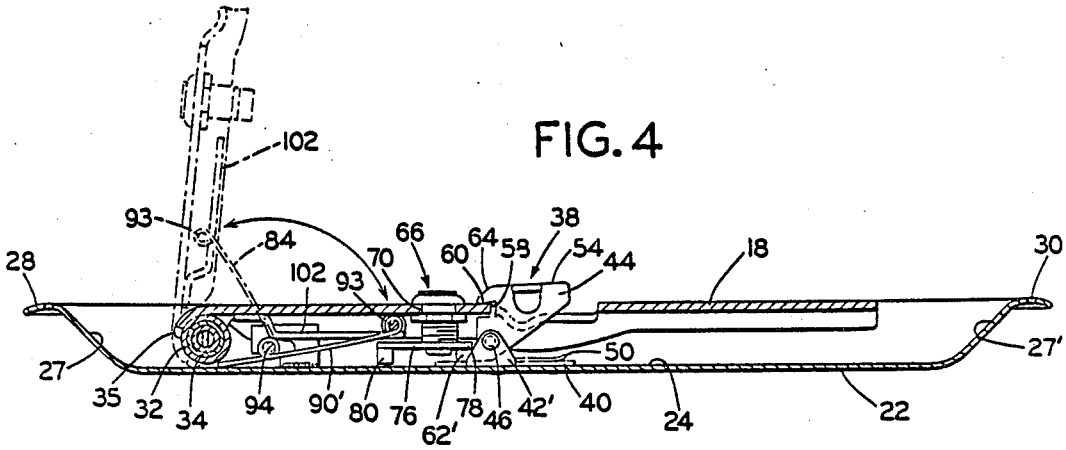
FIG. 4 is a sectional view along line 4—4 of FIG. 2.

Handle 18 is welded to a cylindrical rod 32 which has a length equal to the length of sidewalls 27, 27'. Rod 32 is rigidly attached to a rod 34 which passes through the inside of handle rod 32, and through aligned holes, not shown, in sidewalls 26, 26' to pivotally mount handle 18 in pan 22. Rod 34 projects a short distance beyond sidewalls 26, 26'. The axis of the holes in sidewalls 26, 26' is the pivot axis of handle 18. As best seen in FIG. 4, handle 18 wraps around rod 32 and has a stop 35 which engages the bottom portion 24 of pan 22 when the handle 18 is in the open position, perpendicular to pan 22, to prevent further counter-clockwise movement of handle 18.

Door actuator rod 16 passes through rod 34 and is attached to handle 18 by fasteners, such as screws 36, which pass through aligned holes in handle 18 and rods 32, 34 and 16. Consequently, when handle 18 is pivoted between its flush or closed position and its open position, rod 16 likewise pivots to engage or disengage latch mechanism 20, as described above.

Figure 5:
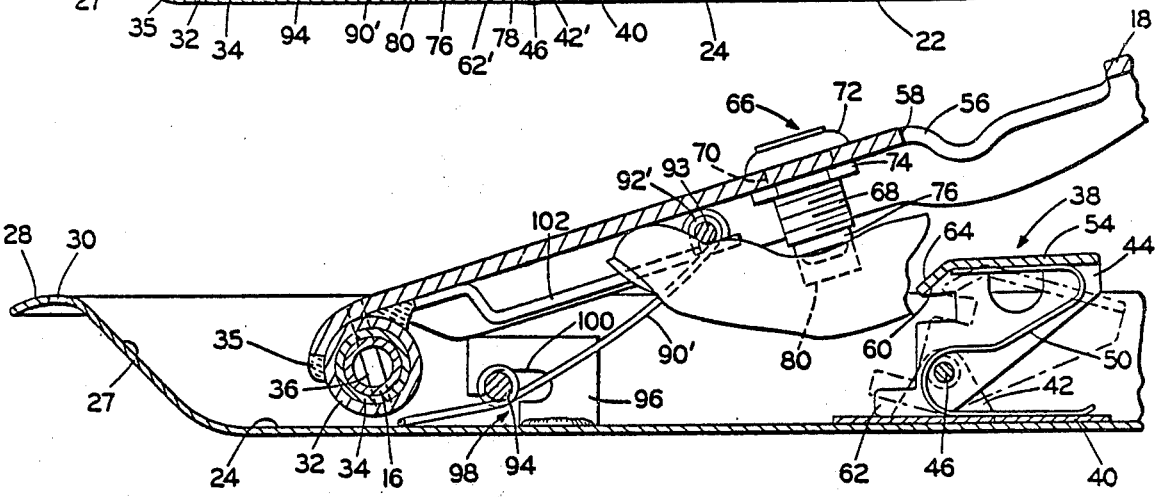
FIG. 5 is an enlarged part sectional view similar to FIG. 4 illustrating removal of the spring biasing means from a bracket on the handle.

Handle 18 is latched in the closed position by a latch mechanism 38, best shown in FIGS. 4 and 5. Latch mechanism 38 includes a base 40 which is welded to the recessed bottom portion 24 of pan 22 and has right and left side members 42, 42', which project perpendicularly from base 40. A latch member 44 is pivotally attached to base 40 by a pin 46 which passes through aligned holes in right and left side members 42, 42'. Latch member 44 is biased in a counter-clockwise direction (as viewed in FIG. 4) by an S-shaped spring 50 which has one end engaging base 40, is looped over pivot pin 46, and has the other end engaging the inside surface of the top 54 of latch member 44. Right and left feet 62, 62' on latch member 44 engage base 40 to limit the counter-clockwise rotation of member 44. Handle 18 is latched in the closed position when the top 54 of latch member 44 projects through a cut-out portion 56 in handle 18 and a front lip 60 on member 44 overlies handle 18 at the forward edge 58 of cut-out portion 56. Handle 18 is unlatched by pushing latch member 44 downward such that it pivots clockwise about pivot pin 46 and front lip 60 does not overlie handle 18.

Latch member 44 has a cam surface 64 on its front lip 60. This surface 64 enables handle 18 to cam latch member 44 clockwise when the handle is moved to closed position. After handle 18 has passed below front lip 60, spring 50 will bias latch member 44 counter-clockwise and front lip 60 will overlie edge 58 of handle 18 to latch the handle 18 in the closed position.

A key-lock mechanism 66 prevents latch member 44 from pivoting out of the latch position. Key-lock mechanism 66 includes a cylindrical body 68 which is threaded on its outside surface. Cylindrical body 68 passes through a hole 70 in handle 18 adjacent cut-out portion 56. Body 68 is secured on handle 18 by a flange 72 and a nut 74 which engage opposite sides of handle 18. When a key is pivoted in lock mechanism 66, an L-shaped member 76 which projects from the bottom of body 68 likewise pivots. Referring to FIG. 4, end 78 of L-shaped member 76 overlies the feet 62, 62' on latch member 44. The short leg 80 of member 76 engages the bottom portion 24 of pan 22. Consequently, when latch member 44 is pushed downwardly, feet 62, 62' engage end 78 of member 76 and force end 80 downward against pan 22 to resist movement of latch member 44. Rotating the key 90° pivots end 78 to uncover feet 62, 62' and enables latch member 44 to rotate clockwise to unlatch handle 18.

Figure 6:
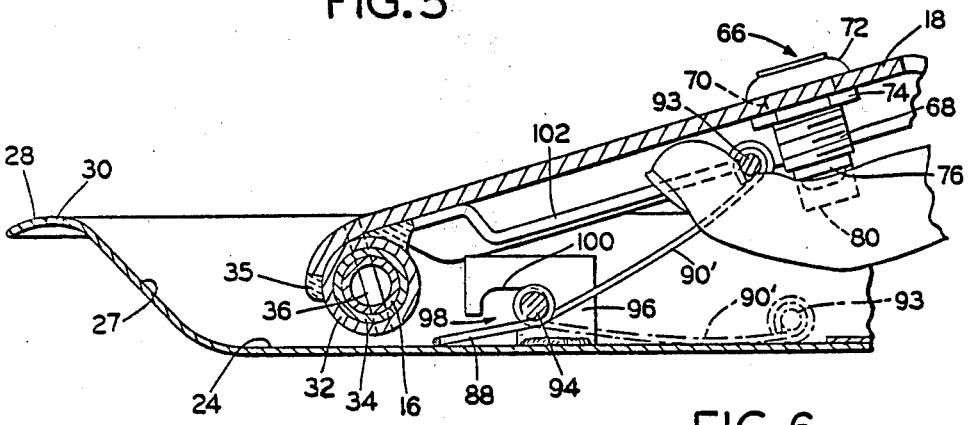
FIG. 6 is a view similar to FIG. 5 showing the position of the spring biasing means after it is disconnected from the bracket.
Figure 7:
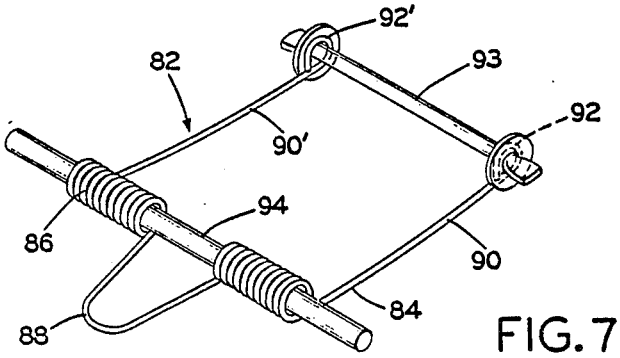
FIG. 7 is a perspective view of the spring assembly.

In the instant invention, handle 18 is continuously biased toward closed position by a spring mechanism 82, shown in FIGS. 5–7. Spring mechanism 82 includes a torsion spring 84 which has a central coiled or wound portion 86, a short U-shaped member 88 and a pair of forwardly extending legs 90, 90' which terminate in small loops 92, 92'. A rod 93 extends through loops 92, 92'.

Installation of torsion spring 84 can best be seen by reference to FIGS. 5 and 6. A rod 94, which has a length equal to the distance between sidewalls 26, 26', is inserted in the coiled portion 86 of spring 84 and the U-shaped portion 88 of the spring is pushed under handle rod 32. In this position, spring rod 94 is located between handle rod 32 and a pair of C-shaped brackets 96, 96' mounted on pan sidewalls 26, 26'. Brackets 96, 96' have a mouth 98 opening in a direction facing rod 32.

Spring rod 94 is pushed downwardly and away from rod 32 into mouth 98 of elongated slots 100 of brackets 96, 96'. Releasing the spring will allow it to move into slots 100. To complete the insertion of spring 84, rod 93 is pulled away from handle rod 32 such that spring rod 94 is moved to the right end of slots 100, as shown in FIG. 6, and rod 93 is passed over the open end of a bracket 102 rigidly affixed to handle 18. Handle 18 must be close to the closed position to permit rod 93 to pass over the end of handle bracket 102.

When handle 18 is raised to the open position, rods 93 slides leftward or downward on handle bracket 102, as viewed in FIG. 6, spring rod 94 is moved to the left in slots 100 and spring 84 is secured. Torsion spring 84 continuously biases handle 18 clockwise toward the closed position. Spring 84 is similar to a constant force spring in that the spring gains torque as leverage is increased when rod 93 slides outward on bracket 102 when handle 18 moves to closed position. This partially offsets the decrease in spring force caused by unwinding of the spring as it moves clockwise.

It can be seen that torsion spring 84 can be inserted in door actuator 10 from the outside of the vehicle without disassembling any part of the door actuator. Torsion spring 84 can be removed by simply reversing the above-mentioned steps. To remove torsion spring 84, handle is moved toward closed position and rod 93 is pulled over the open end of handle bracket 102, as shown in FIG. 6. Spring rod 94 is pushed downwardly toward handle rod 32 until it disengages from slots 100 in C-shaped pan brackets 96, 96'. Rod 93 is lifted up and U-shaped portion 88 of spring 84 is pulled out from under handle rod 32.

It can be seen that the instant invention provides a spring biasing mechanism for constantly biasing the handle 18 to closed position, which mechanism can be inserted or removed without removing door actuator 10 from its installation. Additionally, a simple key-lock mechanism 66 is provided to retain handle 18 in the closed position.

Although a preferred embodiment of the invention has been illustrated and described, it will be apparent to those skilled in the art that various modifications may be made without departing from the spirit and scope of the present invention.

We claim:

1. A self-storing, flush-mounted door latch actuator comprising a pan, a recessed bottom portion in the pan, a handle movable between a stored position within the pan and a released position pivotally attached to the pan, handle storing means connected to the handle characterized by first anchor means attached to the handle, second anchor means attached to the pan, spring means for biasing the handle toward the stored position, manually attachable to and detachable from the first anchor means and the second anchor means, wherein the spring means includes a torsion spring and a rod which passes through the torsion spring, the rod is removably attached to the second anchor means, and one end of the torsion spring is removably connected to the first anchor means.

2. The door latch actuator in claim 1, wherein the first anchor means is a bracket open at one end and the spring means is attached or detached from the bracket by passing the rod which connects the ends of the spring over the open end of the bracket.

3. The door latch actuator in claim 2, wherein the rod which connects the ends of the spring slides on the bracket when the handle is moved between the stored and released positions, such that the spring force acts on the bracket at a point which increases in distance from the handle pivot axis as the handle is moved toward the stored position to thereby compensate for the torque loss of the spring.

4. The door latch actuator in claim 1, wherein the second anchor means includes a pair of rod brackets attached to the pan, each rod bracket has an open end which breaks into an elongated slot for receiving one end of the rod and the rod is attached or detached from the rod brackets by passing one end of the rod through the open end of each rod bracket.

5. The door latch actuator in claim 4, wherein the rod brackets are positioned near the handle pivot, the open ends face the recessed bottom portion of the pan, the slots are elongated in a direction parallel to the recessed bottom portion of the pan, the rod is movable between a first position in which it is located in the ends of the slots nearest the handle pivot when the spring means is attached to the first and second anchor means to bias the handle toward the stored position and a second position in which it is located in the ends of the slots remote from the handle pivot to permit the rod attached to the ends of the spring to pass over the first anchor means for removal therefrom.

6. The door latch actuator in claim 1, including stop means on the handle for limiting the pivotal movement of the handle to prevent breakage of the spring means.

7. The door latch actuator in claim 1, including means for securing the handle which is pivotally attached to the pan and securing means includes a latch member which pivots between a first position in which it engages the handle and retains the handle in the stored position and a second position in which it disengages from the handle and the handle is movable to the released position.

8. The door latch actuator in claim 7, including lock means attached to the handle, the lock means including a cam and the cam is movable between a first position in which it is in interference with the latch member such that the latch member is maintained in its first position and a second position in which it is disassociated with the latch member such that it can pivot to its second position.

* * * * *